US007344026B2

(12) United States Patent
Melgaard

(10) Patent No.: US 7,344,026 B2
(45) Date of Patent: Mar. 18, 2008

(54) PACKAGE AND METHOD OF PACKAGING A PRODUCT

(75) Inventor: Brian Melgaard, Boonton, NJ (US)

(73) Assignee: Powershot Tool Company, Inc., Saddlebrook, NJ (US)

( * ) Notice: Subject to any disclaimer, the term of this patent is extended or adjusted under 35 U.S.C. 154(b) by 180 days.

(21) Appl. No.: 10/633,838

(22) Filed: Aug. 4, 2003

(65) Prior Publication Data

US 2004/0222118 A1 Nov. 11, 2004

Related U.S. Application Data

(60) Provisional application No. 60/402,396, filed on Aug. 9, 2002.

(51) Int. Cl.
*A45C 11/26* (2006.01)

(52) U.S. Cl. ..... 206/349; 206/471

(58) Field of Classification Search ..... 206/349, 206/372, 373, 467, 469, 471
See application file for complete search history.

(56) References Cited

U.S. PATENT DOCUMENTS 4,165,805 A 8/1979 Fethke et al.
4,179,028 A 12/1979 Fethke
4,872,551 A * 10/1989 Theros ..... 206/349
4,899,877 A 2/1990 Kiernan
5,279,417 A 1/1994 Seaton
D358,763 S * 5/1995 Weatherford et al. ..... D9/415
5,435,447 A 7/1995 Weatherford
5,595,295 A * 1/1997 Lin ..... 206/349
5,622,258 A * 4/1997 Baublitz et al. ..... 206/349
5,871,099 A 2/1999 Mellenthin et al.
6,126,008 A 10/2000 Cox
6,311,839 B1 11/2001 Lo
6,401,932 B1 6/2002 Weinstein et al.
6,467,617 B1 10/2002 Chen

FOREIGN PATENT DOCUMENTS

CA 1084455 8/1980
CA 2 142 041 8/1995

OTHER PUBLICATIONS http://www.sepha.com/ezphoto.htm, Sepha Semi-Auto EZ Blister—Blister Packaging Equipment.

* cited by examiner

*Primary Examiner*—Shian T. Luong
(74) *Attorney, Agent, or Firm*—Lerner, David, Littenberg, Krumholz & Mentlik, LLP

(57) ABSTRACT

A package for a product and a method of packaging a product are disclosed. The product has a main body and a handle extending substantially transversely from the body. The package comprises a back panel and a front panel, the back panel and the front panel configured form an enclosure and surround at least a portion of the main body to secure the product in the enclosure such that the handle is exposed so that a user can grip the handle of the product.

6 Claims, 6 Drawing Sheets

PACKAGE AND METHOD OF PACKAGING A PRODUCT

This application claims benefit of application Ser. No. 60/402,396 filed Aug. 9, 2002.

FIELD OF THE INVENTION

The present invention relates to packaging. More particularly, the present invention relates to interactive packaging and methods of packaging products.

BACKGROUND OF THE INVENTION

Interactive packaging is any packaging that contains a product and also enables a person to handle or operate the product without opening the packaging. Interactive packaging may be made of cardboard, plastic, other materials, and combinations of materials.

Blister packages are transparent or translucent plastic packages commonly used to contain and display a variety of products. A blister package usually includes a front plastic panel and a back plastic panel. The front and back panels can be sealed along their edges to form an enclosure, and one or both panels are molded to conform to a portion of the product contained within the package.

Some blister packages are interactive, such as blister packages for staple guns that surround the product on three sides. However, these packages have not been optimized for products having a main body and a handle extending substantially transversely from the body. Such products include a wide variety of tools such as glue guns, power hand drills, hammers, mallets, axes, etc. With respect to glue guns and power hand drills, there exists a need for an interactive package that allows a user to handle or operate the glue gun or power hand drill and activate the trigger mechanism on the glue gun or handle drill.

SUMMARY OF THE INVENTION

The present invention provides a package for products having a body and a handle extending substantially transversely from the body. In preferred embodiments, the package is an interactive blister package.

According to one or more embodiments, a package for a product is provided, the product having a main body and a handle extending substantially transversely from the body. According to these embodiments, the package comprises a back panel and a front panel configured to cooperate with the back panel to form an enclosure and surround at least a portion of the main body to secure the product in the enclosure such that the handle is exposed so that a person can grip the handle of the product.

According to other embodiments, an interactive package for displaying a product having a main body and a handle extending substantially transversely from the main body is provided. According to these embodiments, the interactive package comprises a generally planar first panel configured to cooperate with a generally planar second panel to form an enclosure around at least a portion of the main body of the product. The enclosure has a top portion, a bottom portion, a first side portion, and a second side portion, the first side portion extending between the top and bottom portions and defining inner and outer edges. The second side portion has a cutout extending through a central portion thereof and substantially to the inner edge of the first side portion. The enclosure has a first space within the top portion for securing the body between the first and second panels such that the handle is exposed so that a person can grip the handle.

According to still other embodiments, a method of packaging and displaying a product having a main body and a handle extending substantially transversely from the main body is provided. The method comprises enclosing at least a portion of the main body of the product in a package having first and second panels cooperating to define a space to hold at least a portion of the main body of the product such that the product is secured in the package and the handle is exposed and a user can grip the handle of the product.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF EXEMPLARY EMBODIMENTS

Figure 1:
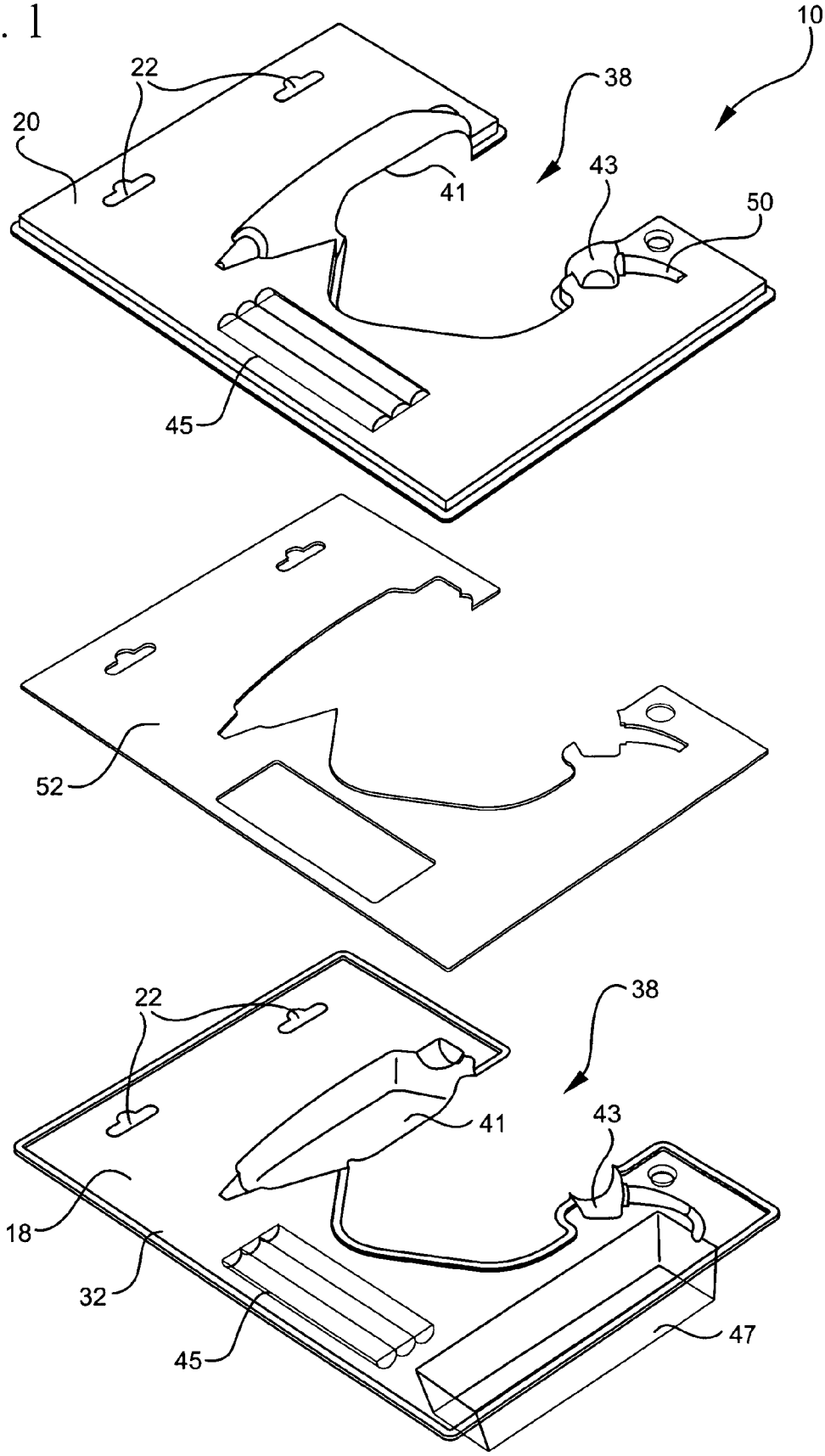
FIG. 1 is an exploded perspective view of a package according to one embodiment of the invention.
Figure 2:
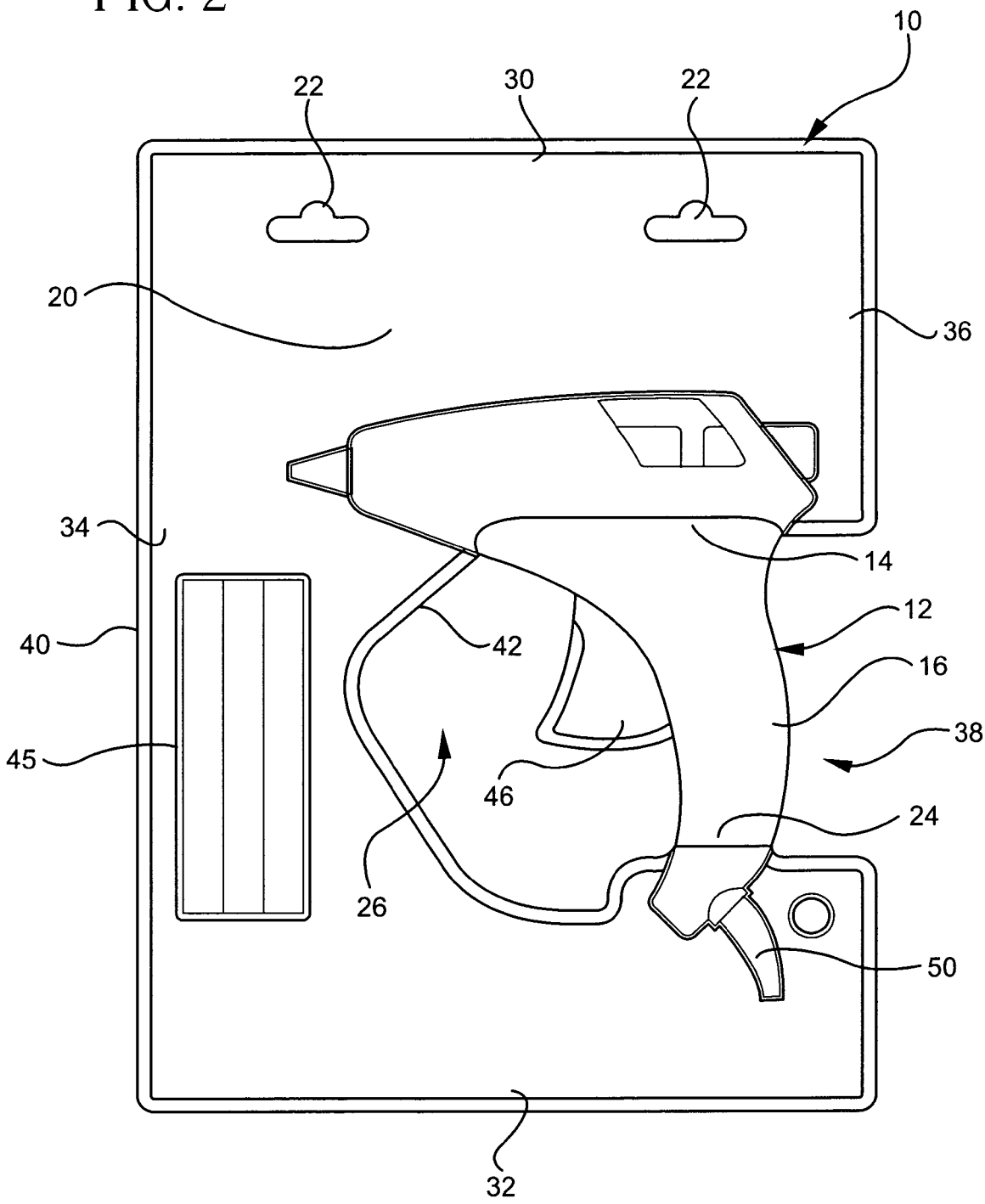
FIG. 2 is a front view of a package for a glue gun in accordance with one embodiment of the present invention.
Figure 3:
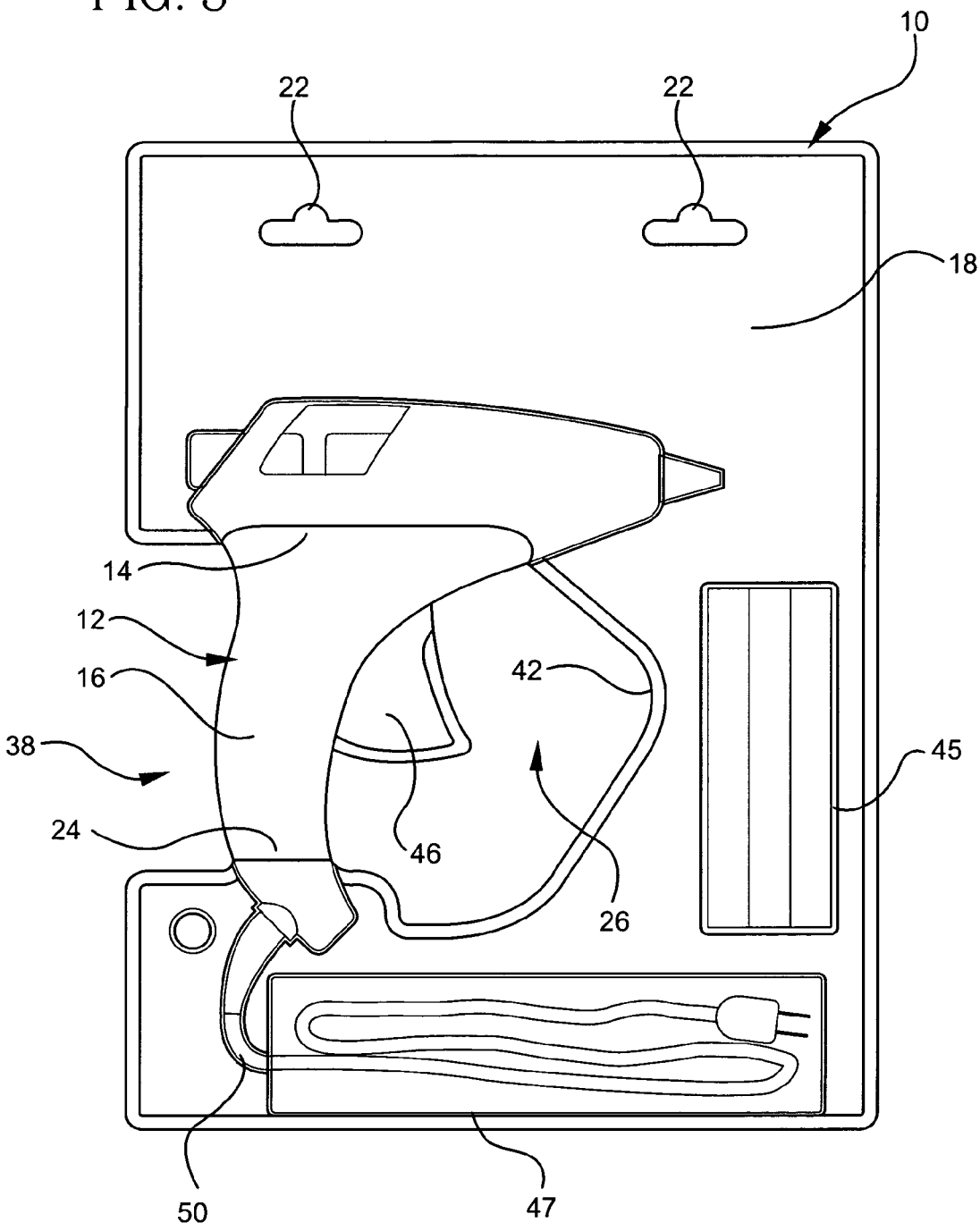
FIG. 3 is a back view of the package shown in FIG. 2.
Figure 4:
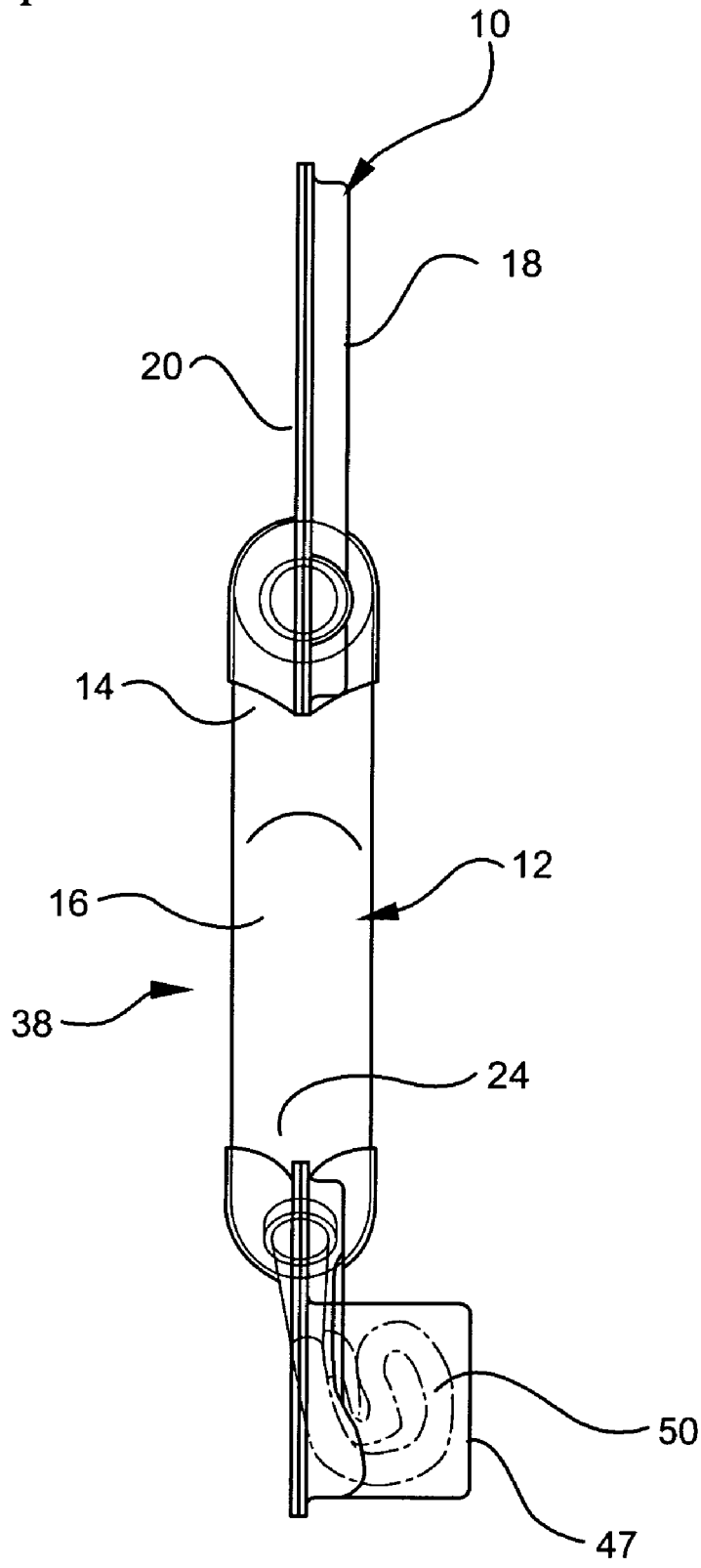
FIG. 4 is an edge view of the package shown in FIG. 2.

Before describing several exemplary embodiments of the invention, it is to be understood that the invention is not limited to the details of construction or process steps set forth in the following description. The invention is capable of other embodiments and of being practiced or carried out in various ways.

In overview, one or more embodiments of the invention relates to a package and a method for holding a product having a main body and a handle extending substantially transversely from the main body. Such products can include but are not limited to hammers, mallets, axes, corded and cordless power drills, and corded and cordless glue guns.

Referring to the drawings and first to FIGS. 1-4, one or more embodiments of the invention relate to a package 10 for a product 12. The product 12 has a main body 14 and a handle 16 extending substantially transversely from the main body 14. The package 10 comprises at least a first generally planar panel, which in the embodiment shown is back panel 18 and a second generally planar panel, which in the embodiment shown is a front panel 20 configured to cooperate with the back panel 18 to form an enclosure and surround at least a portion of the main body 14 to secure the product 12 in the enclosure such that the handle 16 is exposed so that a person can grip the handle of the product.

According to certain embodiments, the handle 16 has a tip 24 defining a bottom portion of the product 12 and the enclosure surrounds at least a portion of the tip 24. In the embodiments shown, the package is substantially C-shaped, and the enclosure surrounds a portion of the handle such that an opening 26 is provided between the package 10 and the handle 16. The opening 26 is sized to allow a person's hand to grip the handle while the product is enclosed in the package. In preferred embodiments, at least one of the panels, and preferably the front panel 20 is transparent or translucent. Preferably, the front panel and back panel are joined along at least one edge. In preferred embodiments, the product 12 includes a glue gun as shown in the Figures. The package 10 may further be configured to enclose accessories for the glue gun.

According to certain embodiments, the enclosure has a top portion 30, a bottom portion 32, a first side portion 34 and a second side portion 36, the first side portion 34 extending between the top portion 30 and the bottom portion 32. The first side portion 34 defines outer edge 40 and inner edge 42. According to one or more embodiments, the second side portion 36 has a cutout 38 extending through a central portion thereof and substantially to the inner edge 42 of the first side portion 34, the enclosure having a first space 41 within the top portion 30 for securing the body between the first and second panels such that the handle 16 is exposed so that a person can grip the handle 16.

The package 10 is designed for mounting on a display rack (not shown), and the package may be attached by methods known in the art such as clipping the product to the rack or standing the product and package on a shelf. In preferred embodiments, the package 10 includes at least one hole 22 formed near the top portion 30 of the package 10 so that the package can be hung on a display rack. A protrusion or prong from the display rack is inserted in the hole 22. In the embodiment shown in the Figures, a pair of holes 22 is provided in the top portion 30 of the package 10. In preferred embodiments, when the package 10 and product 12 are mounted on a display rack, the handle 16 extends in a substantial vertical direction.

The package preferably further comprises a second space 43 defined in the bottom portion 32 between the first and second panels 18, 20 for engaging at least a portion of the tip 24, the first space 41 the second space 43 opening into the cutout 38 so that the handle 16 extends between the second space and the main body 14 of the product 12 and the handle 16 can be gripped by a person while the product remains secured within the enclosure formed by the package 10. As discussed above, the product preferably includes a glue gun and the glue gun includes a trigger 46, and the cutout 36 is designed such that a person can grip the glue gun and grip the trigger 46 while the glue gun is secured in the package 10.

Figure 5:
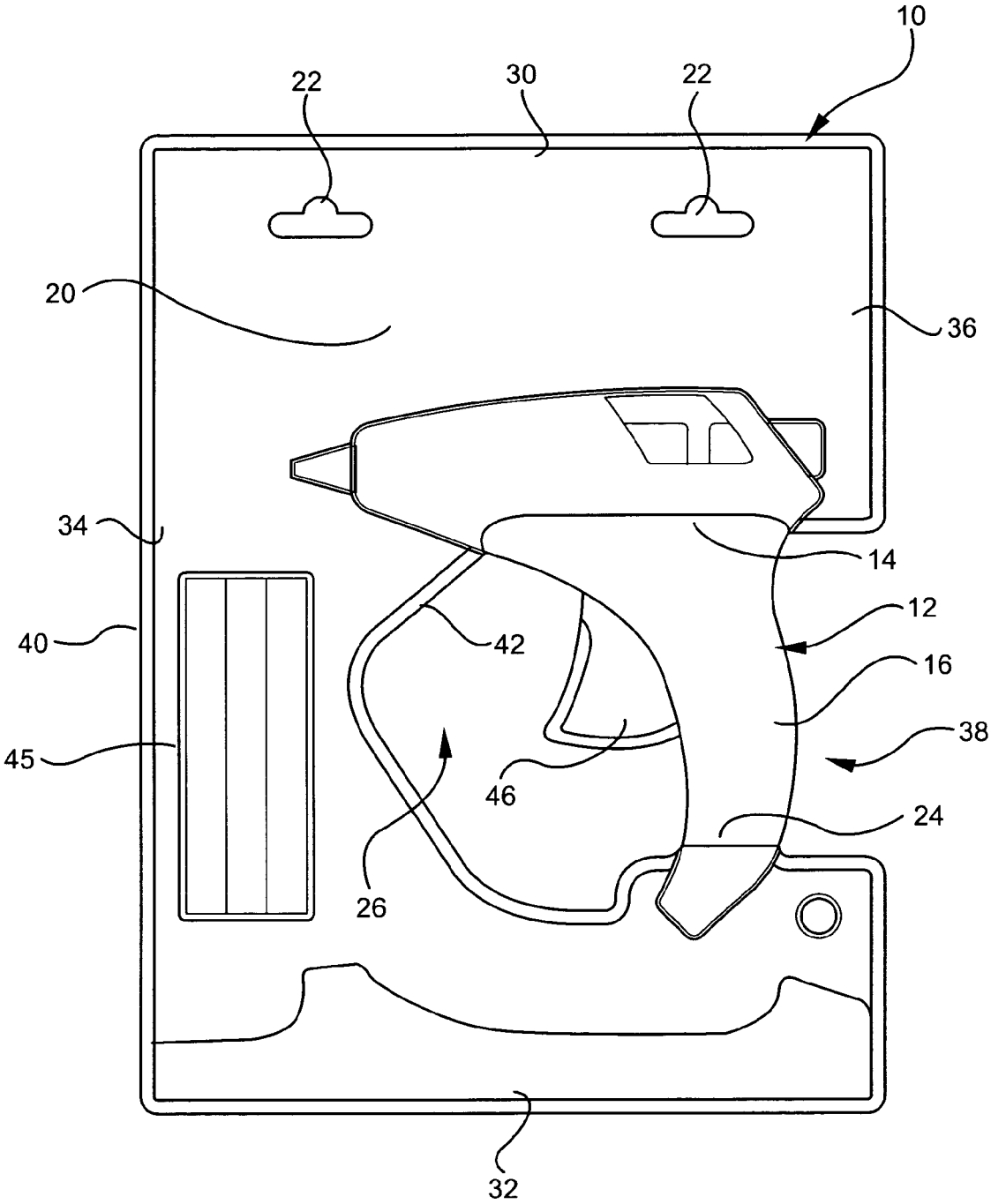
FIG. 5 is a front view of a second embodiment of a package for a glue gun in accordance with the present invention.
Figure 6:
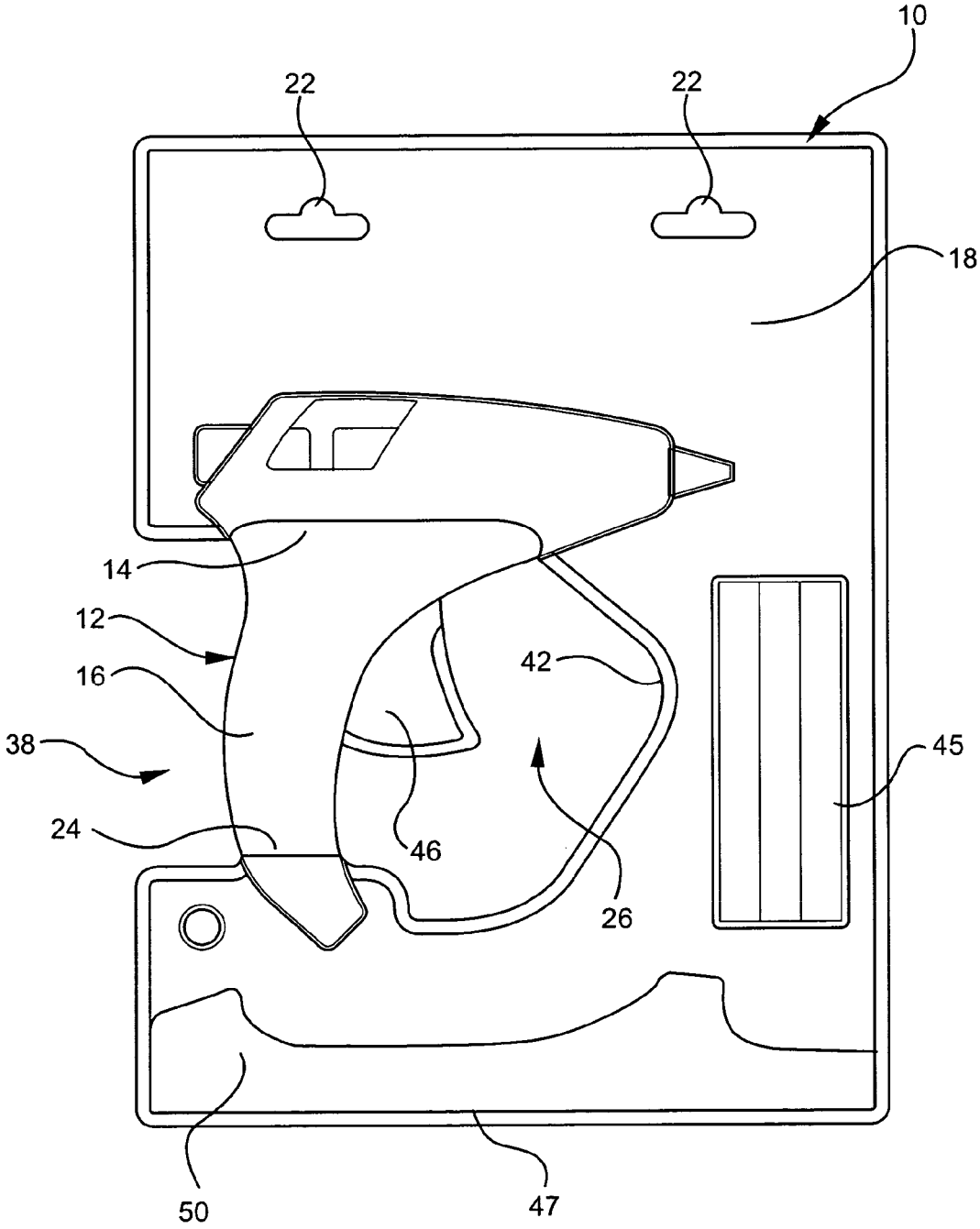
FIG. 6 is a back view of the package shown in FIG. 5.

According to certain embodiments, the package 10 includes at least a third space 45 defined between the first panel 18 and the second panel 20 configured to hold glue gun accessories. Such accessories may include glue supplies, instructions and other accessories. FIGS. 1-4 show a corded glue gun that operates by AC power. Accordingly, a cord 50 extends from the tip 24 of the product 12, and is enclosed within a fourth space 47 between the panels 18, 20. In the embodiments shown in FIGS. 5 and 6, a cordless glue gun is provided. In these embodiments, spaces may be provided between the two panels to enclose glue gun accessories, batteries and a charging apparatus for the batteries (not shown).

It may also be desirable to enclose an insert 52 in the form of a planar sheet of material bearing indicia between the panels. Typically, this will be a thin sheet of cardboard or plastic that has printed thereon the product name and company information that manufactures the product. The sheet of cardboard or plastic may also have desirable product features printed thereon to call these features to the attention of a prospective user. It may also be desirable to include pictures of the product in use to further extol the virtues of the product.

In use, at least a portion of the main body of the product is enclosed in the package so that the product is secured in the package and the handle is exposed and a user can grip the handle of the product. Preferably, at least a portion of the handle is enclosed in the package such that an opening is provided between the handle and the package so that a user's hand can grip the handle.

As is known in the art, the package can be in the form of a blister pack, and it can be formed by methods known by those skilled in the art. The package may be in the form of what is known in the art as a clamshell package, in which there is a hinge on one of the edges of the package, and the remaining three side portions are sealed. In use, a package is formed by thermoforming, blow molding or other suitable techniques, and the product is placed in one or more impressions or spaces formed in one or both of the panels. As noted above, impressions in the panels may be formed to provide spaces for the accessories such as glue supplies, instructions, etc. The accessories and instructions are then placed in the appropriate spaces. The product insert is also seated in one of the panels. Then, the second panel is aligned with the first panel and the product is sealed between the panels using an appropriate technique such as heat sealing. The heat sealing of the edges of the package may be achieved by radio frequency heating or any other suitable technique. The first and second panels may be formed as separate pieces or they may be formed together with a hinge between them as is known in the art.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims and their equivalents.

The invention claimed is:

1. An interactive apparatus for displaying a product, the apparatus comprising:

a product having a main body and only a single handle extending substantially transversely from the main body, the handle having a tip defining a bottom portion of the product;

a package including a generally planar first panel configured to cooperate with a generally planar second panel to form an enclosure, the enclosure having a top portion, a bottom portion, a first side portion and a second side portion, the first side portion extending between the top and bottom portion and defining inner and outer edges, the second side portion having a cutout extending through a central portion thereof and substantially to the inner edge of the first side portion, the top portion having a first space for securing the main body between the first and second panels, and the bottom portion having a second space for securing the tip of the product between the first and second panels, whereby the handle is exposed within the cutout so that a person can grip the handle, when the product is mounted on a display rack, the handle extends in a substantially vertical direction, wherein the first space and the second space open into the cutout so that the handle extends between the first space and the second space, wherein the first panel and second panel are joined along at least one outer edge, wherein the first panel and second panel are joined along the outer edges of the top portion, bottom portion, first side portion and second side portion.

2. The apparatus of claim 1, wherein at least one of the panels is transparent or translucent.

3. The apparatus as in claim 1, wherein the product includes a glue gun.

4. The apparatus as in claim 3, wherein the first and second panels are transparent or translucent.

5. The apparatus of claim 3, wherein the glue gun includes a trigger, and the cutout is designed such that a person can grip the glue gun and grip the trigger while the glue gun is secured in the package.

6. The apparatus of claim 5, wherein the package includes at least a third space defined between the first and second panels configured to hold glue gun accessories.

* * * * *